US006198063B1

(12) United States Patent
Kramer

(10) Patent No.: US 6,198,063 B1
(45) Date of Patent: Mar. 6, 2001

(54) CIRCUIT BREAKER TERMINAL COVER WITH INTEGRATED ARC CHAMBER VENTS

(75) Inventor: Rodney Kramer, Snellville, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/434,435

(22) Filed: Nov. 5, 1999

(51) Int. Cl.[7] ..... H01H 33/04; H01H 9/30
(52) U.S. Cl. ..... 218/157; 200/306
(58) Field of Search ..... 200/304, 306; 218/155, 156, 157, 158; 335/201, 202

(56) References Cited

U.S. PATENT DOCUMENTS

| | | | | |
|---|---|---|---|---|
| 5,194,840 | | 3/1993 | Frutuoso et al. | 335/202 |
| 5,241,289 | | 8/1993 | Markowski et al. | 335/201 |
| 5,278,531 | * | 1/1994 | Link et al. | 335/202 |
| 5,304,761 | | 4/1994 | Rosen et al. | 218/157 |
| 5,811,749 | | 9/1998 | Bausch et al. | 218/157 |

* cited by examiner

*Primary Examiner*—J. R. Scott

(57) ABSTRACT

A multi-phase circuit breaker assembly 10 includes a circuit breaker 12 having a housing 13 containing circuit breaker operating components and having a gas venting chamber 22 associated with each phase of the circuit breaker. The circuit breaker has a plurality of line wiring terminals 26 at a first end 14 of the housing. Each line wiring terminal corresponds to a phase of the circuit breaker. A terminal cover 30 is removably coupled to the first end of the housing so as to cover the line wiring terminals and prevent access to the line wiring terminals when coupled to the first end of the housing, and to gain access to the line wiring terminals only when removed from the first end of the housing. The terminal cover 30 includes a plurality of vent structures 38 integrally formed therewith. Each vent structure is in communication with an associated gas venting chamber and each vent structure is isolated from each other such that arc gases generated in each phase of the circuit breaker are exhausted through an associated vent structure with arc gases from one phase being prevented 1) from coming into contact with arc gases or line wiring terminals of a different phase, and 2) from coming into contact with wiring terminals of the same phase, thereby preventing a short circuit.

18 Claims, 2 Drawing Sheets

CIRCUIT BREAKER TERMINAL COVER WITH INTEGRATED ARC CHAMBER VENTS

FIELD OF THE INVENTION

This invention relates to circuit breakers and more particularly to a terminal cover which enables exhaust gases to vent from the circuit breaker during a circuit interrupt condition.

BACKGROUND OF THE INVENTION

Many industrial molded case circuit breakers have terminals and provisions for wiring connectors at each end of the circuit breaker. Frequently in the design of circuit breakers, a removable terminal cover is provided. With the terminal cover removed, the electrician has easy access to the breaker terminals for assembling, tightening, or inspecting the electrical connections. When the terminal cover is replaced, the cover helps prevent accidental contact with the live terminals from the front of the circuit breaker. A second function of a terminal cover is to prevent hot, ionized gases caused by short circuit interruption from exiting from the front of the circuit breaker. Such gases could strike grounded metal on the front of the equipment enclosure and cause an electrical ground fault.

Typically, hot, ionized gases from short circuit interruption are exhausted from an arc chamber of the circuit breaker. Often, the design of the circuit breaker is such that the hot gases flow against the terminal connections before exiting the circuit breaker. After the gases exit the circuit breaker, the exhaust from the different poles of the breaker, which are at different electrical potentials, mix together. This mixing can result in a phase-to-phase arcing fault across the terminals of the circuit breaker. Additionally, there exists the potential for shorting the electrical path through the circuit breaker arc stack by arcing from the open moving blade directly to the lug, thereby eliminating the arc stack from the current path. This may result in the circuit breaker being unable to perform its primary function of interrupting the short circuit current.

The problem of phase-to-phase arcing in a circuit breaker has been addressed. One solution is to lengthen the walls of the molded case so that the walls extend further beyond the wiring lugs. This lengthens the path required for a phase-to-phase arc and thus reduces the likelihood that a phase-to phase arc will occur. However, this solution has the disadvantage of increasing the overall size of the circuit breaker.

Another solution is to guide the gases so that they exit the breaker without coming into contact with the breaker terminals and wiring lugs. U.S. Pat. No. 5,811,749 provides a terminal cover having chamber vents. Access holes for receiving a tool are provided to reach through the cover to tighten the terminal screws. The access holes are tubular in shape and extend through the arc chamber vents. Thus, the access holes disadvantageously reduce the cross-sectional area of the vents and restrict the flow of gases. In addition, the tubular access holes require a complicated and costly mold which requires cross-slides from opposite directions.

Accordingly, there is a need to provide an improved terminal cover for a circuit breaker which effectively permits arc gases to be vented from the circuit breaker while preventing access to the line terminals.

SUMMARY OF THE INVENTION

An object of the present invention is to fulfill the need referred to above. In accordance with the principles of the present invention, this objective is obtained by providing a multi-phase circuit breaker assembly including a circuit breaker having a housing containing circuit breaker operating components and having a gas venting chamber associated with each phase of the circuit breaker. The circuit breaker has a plurality of line wiring terminals at a first end of the housing. Each line wiring terminal corresponds to a phase of the circuit breaker. A terminal cover is removably coupled to the first end of the housing so as to cover the line wiring terminals and prevent access to the line wiring terminals when coupled to the first end of the housing, and to gain access to the line wiring terminals only when removed from the first end of the housing. The terminal cover includes a plurality of vent structures integrally formed therewith. Each vent structure is in communication with an associated gas venting chamber and each vent structure is isolated from each other such that arc gases generated in each phase of the circuit breaker are exhausted through an associated vent structure with arc gases from one phase being prevented 1) from coming into contact with arc gases or line wiring terminals of different phases, and 2) from coming into contact with a line wiring terminal of the same phase, thereby preventing a short circuit.

A method of venting gases from a multi-phase circuit breaker assembly during a circuit interrupt condition is also provided.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

DETAILED DESCRIPTION OF THE INVENTION

Figure 1:
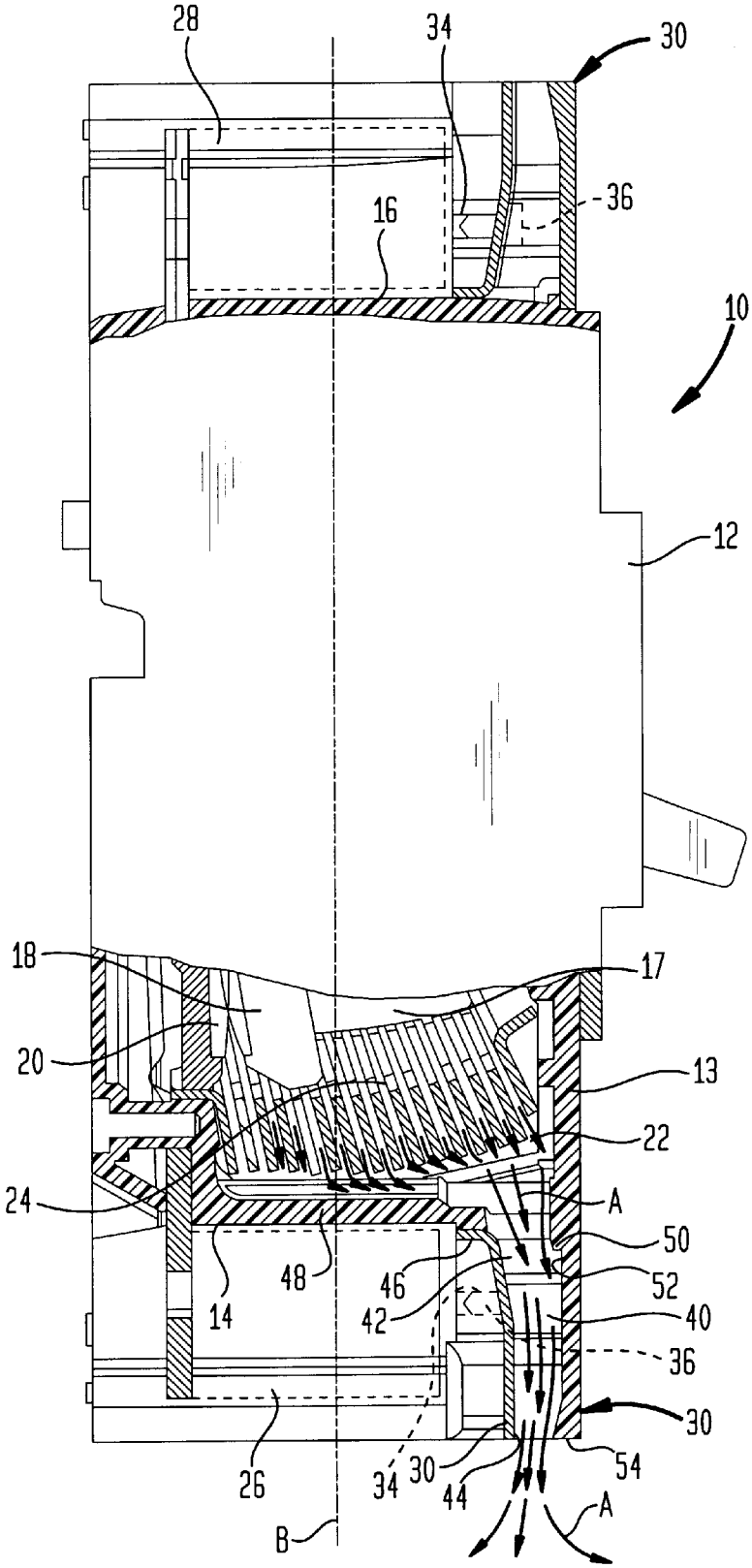
FIG. 1 is side view of a circuit breaker, partially in section, including terminal covers provided in accordance with the principles of the present invention.

Referring to FIG. 1, a circuit breaker assembly having terminal covers in accordance with the principles of the present invention is shown generally indicated at 10.

The circuit breaker assembly 10 comprises an industrial rated multiphase circuit breaker 12. In the illustrated embodiment, the circuit breaker 12 includes a molded plastic housing 13 having a first end 14 and an opposing second end 16.

In the illustrated embodiment, the circuit breaker 12 is a three phase circuit breaker and thus comprises three separate line terminal compartments within the housing 13. As shown in FIG. 1, each line terminal compartment 17 contains the circuit breaker operating components including a moving contact 18 and a stationary contact 20. A gas venting chamber 22 surrounds and guides the arc that occurs upon separation of the stationary and movable contacts. The arc gases that are generated during intense circuit interruption are dispersed through a plurality of arc plates 24 to rapidly cool and de-ionize the electrically charged arc gases. The arc gases are indicated by the arrows A in FIG. 1.

A line wiring terminal 26 is associated with each line terminal compartment and thus each phase of the circuit breaker 12. The circuit breaker 12 also includes a load wiring terminal 28 at the second end 16 of the housing 13 associated with each phase of the circuit breaker 12.

The arc gases exiting from the gas venting chamber 22 of one line terminal compartment 17 must be prevented from contacting a line wiring terminal within the same and/or an adjacent line terminal compartment to prevent a so-called "phase-to-phase" fault.

Figure 2:
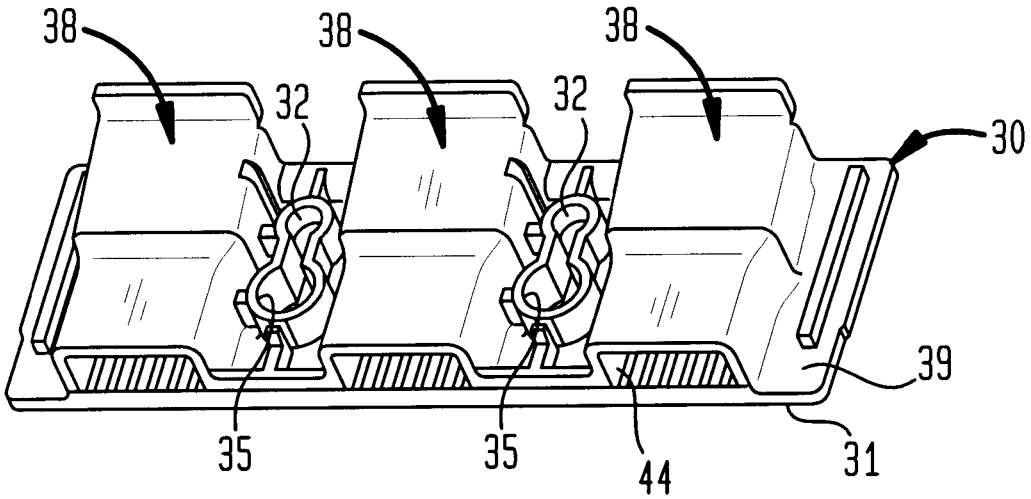
FIG. 2 is a perspective view of a terminal cover of the invention as seen from the bottom thereof.
Figure 3:
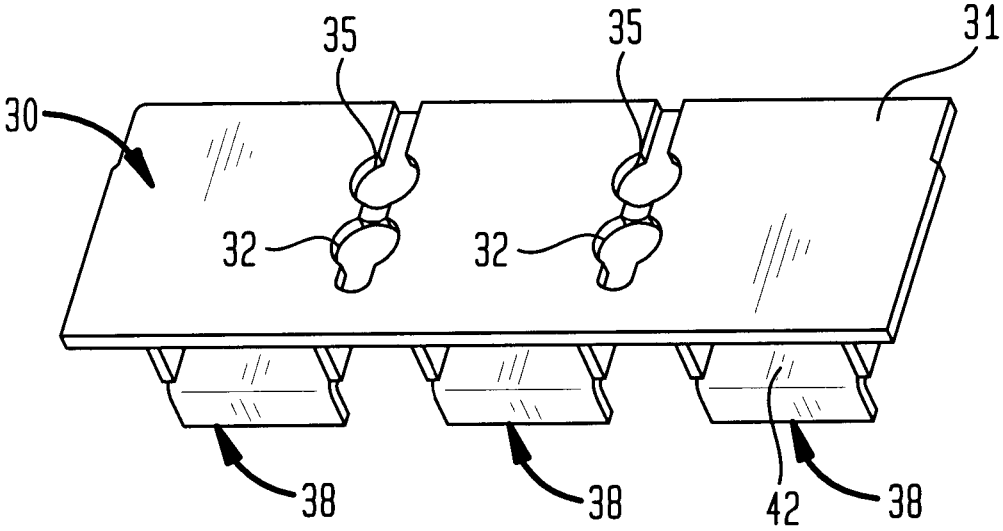
FIG. 3 is a perspective view of a terminal cover of the invention as seen from the bottom thereof.

Thus, in accordance with the principles of the present invention, a terminal cover, generally indicated at 30, is provided and is removably coupled to the first end 14 of the housing 13. As best shown in FIGS. 2 and 3, the terminal cover 30 includes a generally plate-like main body 31 having a pair of fastener apertures 32 therethrough. Each fastener aperture aligns with a housing aperture 34 defined in a front face of the housing 13 (FIG. 1). A threaded fastener 36 extends through each fastener aperture 32 and engages the associated housing aperture 34 in the housing 13 to couple the terminal cover 30 to the circuit breaker 12. When the terminal cover 30 is secured to the housing 13, finger and tool access to the wiring terminals is prevented. Thus, a greater degree of protection against ingress of solid foreign bodies is provided by the terminal cover of the invention, as compared to terminal covers which permit tool and or finger access to the terminals. Only when the terminal cover 30 is removed from the housing 13, upon removing the fasteners 36, is access to the wiring terminals 26 or 28 achieved. The terminal cover 30 also includes a pair of access apertures 35 therethrough which provide access to fasteners which are employed to secure the circuit breaker 12 to a panel (not shown).

The terminal cover 30 includes a plurality of vent structures, generally indicated at 38, formed integrally therewith. Preferably, the terminal cover 30 with vent structures 38 is molded from plastic in a single process. However, the terminal cover 30 may be produced as separate pieces then joined by one of several methods, for example, with the use of adhesive, snap fits, heat staking, etc. Each vent structure 38 is formed so as to extend from a surface 39 of the main body 31 and is generally U-shaped defining an open passageway 40 between an inlet opening 42 and an exit opening 44. In the illustrated embodiment, each vent structure 38 has a flange 46 near the inlet opening 42 which abuts surface 48 of the first end 14 of the circuit breaker 12. The flange 46 is not required, but aids in coupling the vent structure 38 to the circuit breaker 12. In addition, the housing 13 of the circuit breaker 12 includes a protruding portion 50 associated with each vent structure 38. Thus, as shown in FIG. 1, a protruding portion 50 is received in the inlet opening 42 and abuts an interior surface 52 of the associated vent structure 38. Each inlet opening 42 is in open communication with respect to an associated gas venting chamber 22 and each vent structure 38 is isolated from each other such that arc gases generated in each phase of the circuit breaker 12 are exhausted through an associated vent structure 38 with arc gases from one phase being prevented from coming into contact with arc gases or line wiring terminals 26 of different phases, or with a line wiring terminal 26 of the same phase. Thus, a short circuit is prevented.

In addition, the vent structures 38 are constructed and arranged to guide arc gases outwardly from the circuit breaker 12 in a direction of long axis B of the circuit breaker 12. Surface 52 of end 54 of each vent structure 38 is tapered to directed gases away from the front of the circuit breaker 12. Thus, the gases are directed away from grounded metal on the front of the equipment enclosure to prevent an electrical ground fault.

In the illustrated embodiment, the circuit breaker 12 has three phases. Thus, three vent structures 38 are provided. It can be appreciated that the terminal cover 30 can be used with circuit breakers having phases other than three by modifying the terminal cover to have the same amount of vent structures as circuit breaker phases.

As shown in FIG. 1, a terminal cover 30 is provided over the load wiring terminals 28 as well. Thus at the load end of the circuit breaker 12, the terminal cover 30 merely functions as a protective cover. Alternatively, a terminal cover having no vent structures can be employed at the load end of the circuit breaker 12.

As can be appreciated from the drawings, the access apertures 35 and fastener apertures 32 do not interfere with the vent structures 38. Since there are no access holes through the vent structures as in prior art structures, the vent structures 38 of the invention are not restricted and the gases can flow more freely. This facilitates arc interruption by blowing the arc into the arc plates more quickly. Further, the vent structures are useful in a large circuit breaker because a large vent area is needed due to increased gas flow. The terminal cover 30 is easy to manufacture since the mold requires a cross slide from only one direction.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A multi-phase circuit breaker assembly comprising:

a circuit breaker having a housing containing circuit breaker operating components and having a gas venting chamber associated with each phase of the circuit breaker; the circuit breaker having a plurality of line wiring terminals at a first end of said housing, each line wiring terminal corresponding to a phase of the circuit breaker; and a terminal cover removably coupled to said first end of said housing so as to cover said line wiring terminals and prevent access to said line wiring terminals when coupled to said first end of said housing, and to gain access to said line wiring terminals only when removed from said first end of said housing, said terminal cover including a plurality of vent structures integrally formed therewith, each vent structure being in communication with an associated gas venting chamber and each vent structure being isolated from each other such that arc gases generated in each phase of the circuit breaker are exhausted through an associated vent structure with arc gases from one phase being prevented 1) from coming into contact with arc gases or line wiring terminals of different phases, and 2) from coming into contact with a line wiring terminal of the same phase, thereby preventing a short circuit.

2. The circuit breaker assembly according to claim 1, wherein said circuit breaker has a long axis, said vent structures being constructed and arranged to guide arc gases outwardly from said circuit breaker in a direction generally of said long axis.

3. The circuit breaker assembly according to claim 2, wherein each of said vent structures has an inlet opening communicating with an exit opening, an inside surface of each of said vent structures being tapered near said exit opening so as to direct gases exiting the exit opening away from a front surface of said circuit breaker.

4. The circuit breaker assembly according to claim 3, wherein each of said vent structures has openings defined only at said inlet opening and at said exit opening, said terminal cover being constructed and arranged to prevent finger and tool access to said line wiring terminals when said terminal cover is coupled to said circuit breaker.

5. The circuit breaker assembly according to claim 1, wherein said terminal cover is molded from plastic with said vent structures are molded integrally therewith.

6. The circuit breaker assembly according to claim 1, wherein said terminal cover includes a fastener aperture therein and said first end of said housing includes a housing aperture, a threaded fastener being received in said fastener aperture and being engaged with said housing aperture to couple said terminal cover to said housing.

7. The circuit breaker assembly according to claim 1, wherein said circuit breaker is a three-phase circuit breaker and said terminal cover includes three vent structures.

8. The circuit breaker assembly according to claim 3, wherein said first end of said circuit breaker includes protruding portions, a protruding portion being received in an inlet opening of an associated vent structure and abutting an interior wall of the associated vent structure when the terminal cover is coupled to said housing.

9. The circuit breaker assembly according to claim 1, wherein said terminal cover includes a pair of access apertures therein constructed and arranged to gain access to circuit breaker mounting fasteners.

10. The circuit breaker according to claim 1, further comprising:

a plurality of load wiring terminals at a second end of said housing which is opposite said first end of said housing, each load wiring terminal corresponding to a phase of the circuit breaker; and a second terminal cover removably coupled to said second end of said housing so as to cover said load terminals.

11. The circuit breaker assembly according to claim 1, wherein said terminal cover includes a plate-like main body and each of said vent structures is generally U-shaped and extends from a surface of said main body to define an open passageway.

12. A terminal cover for a multi-phase circuit breaker, the circuit breaker having a housing containing circuit breaker operating components and having a gas venting chamber associated with each phase of the circuit breaker and a plurality of line terminals at a first end of the housing, each line terminal corresponding to a phase of the circuit breaker, the terminal cover comprising:

a main body having fastener apertures therein constructed and arranged to receive a fastener to removably couple the terminal cover to the first end of the housing so as to cover the terminals and prevent access to the terminals when coupled to the housing, and to gain access to the terminals only when removed from the housing, and a plurality of vent structures integrally formed with the main body, each vent structure being constructed and arranged to communicate with an associated gas venting chamber when coupled to the circuit breaker, each vent structure being isolated from each other such that arc gases generated in each phase of the circuit breaker are exhausted through an associated vent structure with arc gases from one phase being prevented 1) from coming into contact with arc gases or line wiring terminals of different phases, and 2) from coming into contact with a line wiring terminal of the same phase, thereby preventing a short circuit.

13. The terminal cover according to claim 12, wherein each of said vent structures has an inlet opening communicating with an exit opening, an inside surface of each of said vent structures being tapered near said exit opening so as to direct gases exiting the exit opening away from a front surface of the circuit breaker when the terminal cover is coupled to the circuit breaker.

14. The terminal cover according to claim 13, wherein each of said vent structures has openings defined only at said inlet opening and at said exit opening, said terminal cover being constructed and arranged to prevent finger and tool access to the terminals when said terminal cover is coupled to the circuit breaker.

15. The terminal cover according to claim 12, wherein said main body and said vent structures are molded integrally from plastic.

16. The terminal cover according to claim 12, further comprising a pair of access apertures therein constructed and arranged to gain access to fasteners which mount the circuit breaker.

17. The circuit breaker assembly according to claim 12, wherein each of said vent structures is generally U-shaped and extends from a surface of said main body to define an open passageway.

18. A method of venting gases from a multi-phase circuit breaker assembly during a circuit interrupt condition, the circuit breaker having a housing containing circuit breaker operating components and having a gas venting chamber associated with each phase of the circuit breaker, the circuit breaker having a plurality of line wiring terminals at a first end of the housing, each line wiring terminal corresponding to a phase of the circuit breaker; a terminal cover is removably coupled to the first end of the housing so as to cover the line wiring terminals and prevent access to the line wiring terminals when coupled to the first end of the housing, and to gain access to the line wiring terminals only when removed from the first end of the housing, the method including:

providing a plurality of vent structures formed integrally with said terminal cover, each of said vent structures having only an inlet opening and an exit opening in communication with said inlet opening, and arranging the vent structures such that the inlet opening of each vent structure is in communication with an associated gas venting chamber and each vent structure is isolated from each other such that arc gases generated in each phase of the circuit breaker are exhausted through the exit opening of an associated vent structure with arc gases from one phase being prevented 1) from coming into contact with arc gases or line wiring terminals of different phases, and 2) from coming into contact with a line wiring terminal of the same phase, thereby preventing a short circuit.

* * * * *